US007736247B2

(12) United States Patent
Caruso

(10) Patent No.: US 7,736,247 B2
(45) Date of Patent: Jun. 15, 2010

(54) BASE SUPPORT FOR A SPORT TRAINING OBSTACLE

(75) Inventor: Anthony Caruso, Center Valley, PA (US)

(73) Assignee: Kwik Goal Ltd., Quakertown, PA (US)

( * ) Notice: Subject to any disclaimer, the term of this patent is extended or adjusted under 35 U.S.C. 154(b) by 215 days.

(21) Appl. No.: 12/126,496

(22) Filed: May 23, 2008

(65) Prior Publication Data

US 2009/0291781 A1 Nov. 26, 2009

(51) Int. Cl.
*A63B 69/00* (2006.01)

(52) U.S. Cl. ..... 473/444; 473/422; 473/447; 473/476

(58) Field of Classification Search ..... 473/422, 473/444, 441, 446, 438, 448; 434/247, 250, 434/251; 482/4, 83–90; D21/621, 781; 273/407, 348, 410

See application file for complete search history.

(56) References Cited

U.S. PATENT DOCUMENTS 3,398,954 A * 8/1968 Nedwick ..... 473/438
3,552,749 A 1/1971 Piggotte
3,573,867 A 4/1971 Mehrens
3,658,329 A 4/1972 Ciccarello
3,675,921 A 7/1972 Meyers, Sr.
3,810,618 A * 5/1974 Nedwick ..... 473/439
4,168,062 A 9/1979 McCarthy et al.
4,489,940 A 12/1984 Amundson
4,869,503 A 9/1989 Grasso
4,934,938 A 6/1990 Orlandi et al.
D321,370 S 11/1991 Curtis
5,088,680 A * 2/1992 Farmer ..... 248/523
5,205,799 A 4/1993 Carbonero
5,485,993 A * 1/1996 Lipsett ..... 473/448
5,527,185 A * 6/1996 Davis ..... 473/438
5,554,088 A * 9/1996 Zlojutro ..... 482/83
5,676,378 A * 10/1997 West ..... 273/407
5,685,542 A 11/1997 Weis
5,772,538 A 6/1998 Sztykiel et al.
5,860,386 A * 1/1999 Schwab et al. ..... 116/63 P
5,878,518 A * 3/1999 Grewe ..... 40/606.02
5,928,093 A 7/1999 Lai
6,012,994 A 1/2000 Beluse
6,405,989 B2 6/2002 Davis et al.
6,543,777 B2 4/2003 Carbonero
6,726,208 B2 * 4/2004 Wilkus ..... 273/407
6,866,595 B1 3/2005 Elder et al.
6,866,596 B2 3/2005 Steed et al.
7,131,917 B2 * 11/2006 Spencer ..... 473/444

(Continued)

*Primary Examiner*—Mitra Aryanpour
(74) *Attorney, Agent, or Firm*—Howson & Howson LLP

(57) ABSTRACT

A training device for use as a playing field obstacle during athletic training exercises. The training device includes a weighted base supportable on an underlying ground surface. The base has at least one wheel enabling ready repositioning of the base on the playing field and an upper wall with an upward-opening slot. The base can also include a dummy obstacle having a body portion and a base plug portion. The base plug portion is receivable within the slot of the base for connecting the dummy obstacle to the base such that, when the dummy obstacle is connected to the base, the body portion of the dummy obstacle is supported in a substantially upright position. The base may further include one or more coaching sticks removably secured within receptacles in a position extending or projecting from the base.

16 Claims, 4 Drawing Sheets

U.S. PATENT DOCUMENTS 7,147,579 B2 * 12/2006 Forrest ..... 473/441
7,156,760 B2 1/2007 Berdugo et al.
7,198,580 B2 4/2007 Elder et al.
7,658,689 B2 * 2/2010 Crook, II ..... 473/447

* cited by examiner

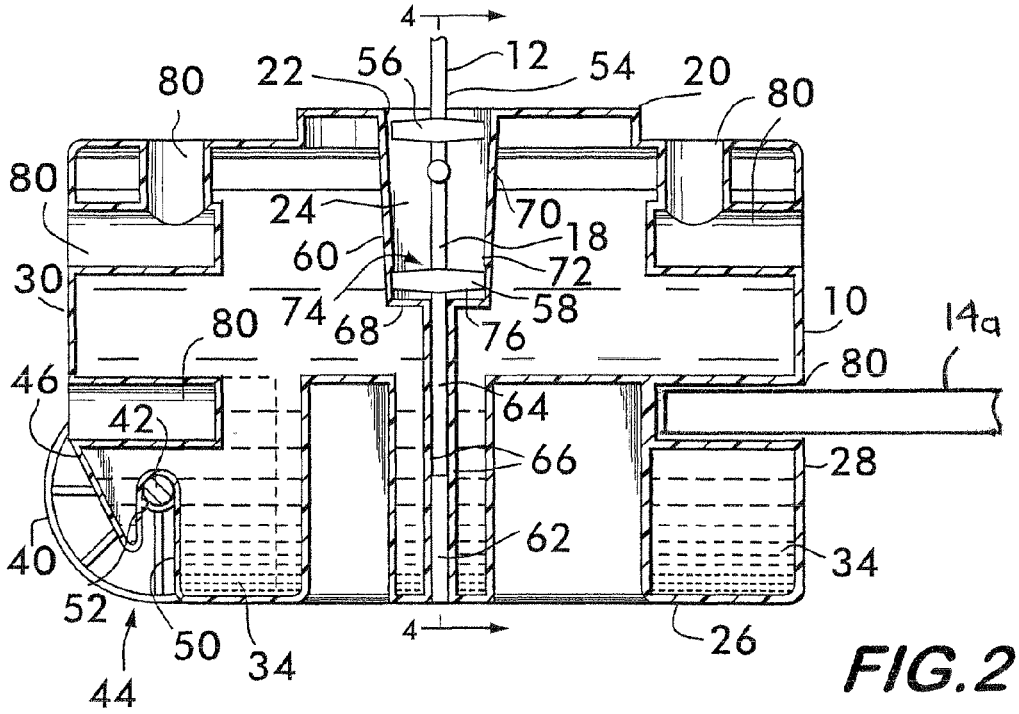
FIG. 2
FIG. 3
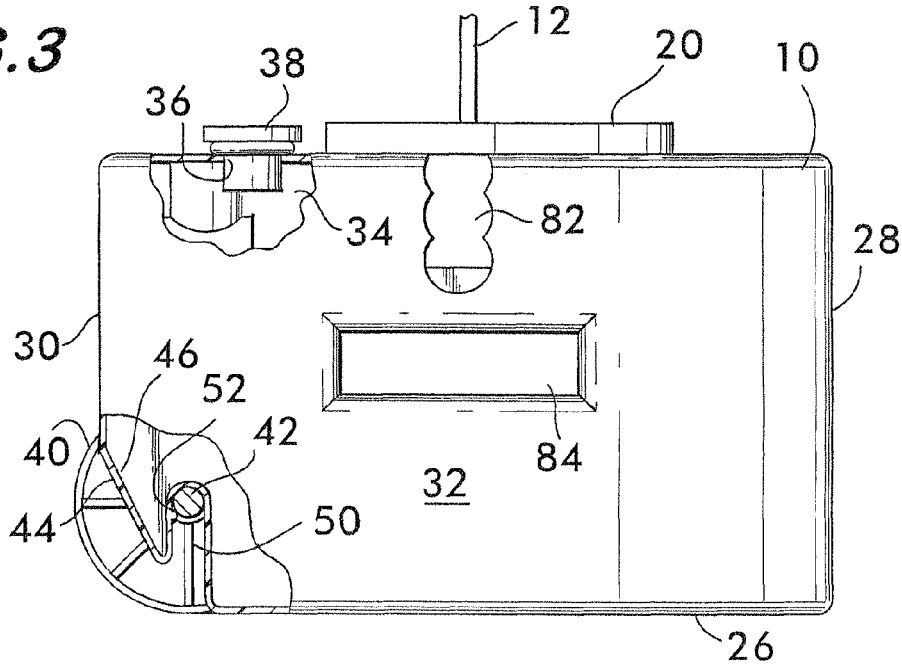

BASE SUPPORT FOR A SPORT TRAINING OBSTACLE

BACKGROUND OF THE INVENTION

The present invention relates to an obstacle for placement on a playing field and use during training exercises, such as footwork, coordination, speed, and/or agility training exercises for soccer or like sport, and more particularly, the present invention relates to a support for a humanoid figure, or dummy player, arranged to provide an obstacle or like training device used during such training exercises.

For purposes merely of example, U.S. Pat. No. 4,934,938 issued to Orlandi et al. discloses a silhouette dummy of generally human form suitable for use during training exercises, such as, training exercises for football, rugby and like sports. The base of the silhouette dummy includes spikes for being inserted into the ground for anchoring the silhouette dummy to a natural grass playing field.

Playing field obstacle devices specifically adapted for soccer training are disclosed by U.S. Pat. Nos. 6,866,595 B1 and 7,198,580 B2 issued to Elder et al. Other types of training obstacles and/or dummies are disclosed by U.S. Pat. Nos. 4,869,503 issued to Grasso; U.S. Pat. Nos. 3,658,329 issued to Ciccarello; D. U.S. Pat. Nos. 321,370 issued to Curtis; U.S. Pat. Nos. 3,552,749 issued to Piggotte; U.S. Pat. Nos. 5,527,185 issued to Davis; U.S. Pat. Nos. 3,675,921 issued to Meyers, Sr.; U.S. Pat. Nos. 5,772,538 issued to Sztykiel et al.; U.S. Pat. Nos. 5,928,093 issued to Lai; U.S. Pat. Nos. 3,573,867 issued to Mehrens; U.S. Pat. Nos. 4,168,062 issued to McCarthy et al.; U.S. Pat. Nos. 4,489,940 issued to Amundson; U.S. Pat. Nos. 6,012,994 issued to Beluse; and U.S. Pat. Nos. 7,156,760 B2 issued Berdugo et al.

Although the above referenced athletic training devices, obstacles, and dummies disclosed by the above referenced patents may be satisfactory for their intended purpose, there is a need for a silhouette dummy or like obstacle that can be readily positioned and re-positioned in a manner requiring a minimum of time, effort, skill and labor on both natural and artificial surfaces without the use of ground-insertion spikes or the like. In addition, preferably the apparatus should be capable of ready transport to and from the practice field in a compact condition and capable of ready arrangement on the playing surface in any desired layout.

BRIEF SUMMARY OF THE INVENTION

The present invention is a training device for use as a playing field obstacle during athletic training exercises. The training device includes a weighted base having a bottom wall supportable in a stationary position on an underlying ground surface solely due to the forces of friction and gravity. The base has at least one wheel enabling ready repositioning of the base on the playing field and an upper wall with an upward-opening slot. The training device also includes a separate dummy obstacle having a body portion and a base plug portion. The base plug portion is receivable within the slot of the base for connecting the dummy obstacle to the base such that, when the dummy obstacle is connected to the base, the body portion of the dummy obstacle is supported in a substantially upright position.

The training device can also include one or more coaching sticks separate from the base and dummy obstacle. The base includes at least one receptacle for removably securing and supporting the coaching stick in a position extending or projecting from the base.

BRIEF DESCRIPTION OF THE DRAWINGS

The present invention should become apparent from the following description when taken in conjunction with the accompanying drawings, in which:

FIG. 2 is a cross-sectional view along line 2-2 of FIG. 1;

FIG. 3 is a partially cut-away side elevational view of the support base according to the present invention;

DETAILED DESCRIPTION OF THE INVENTION

The present invention is directed to a base, or support, 10 for supporting a separate dummy, mannequin, or like obstacle 12 and/or an arrangement of coaching sticks 14 or the like on a playing or practice field or like surface. The combination of the base 10 and dummy 12 and/or coaching sticks 14 can be used as obstacles, opponents, practice aids, or the like during athletic training exercises, such as soccer training exercises or exercises for developing footwork, coordination, agility, and speed skills in athletes.

Figure 1:
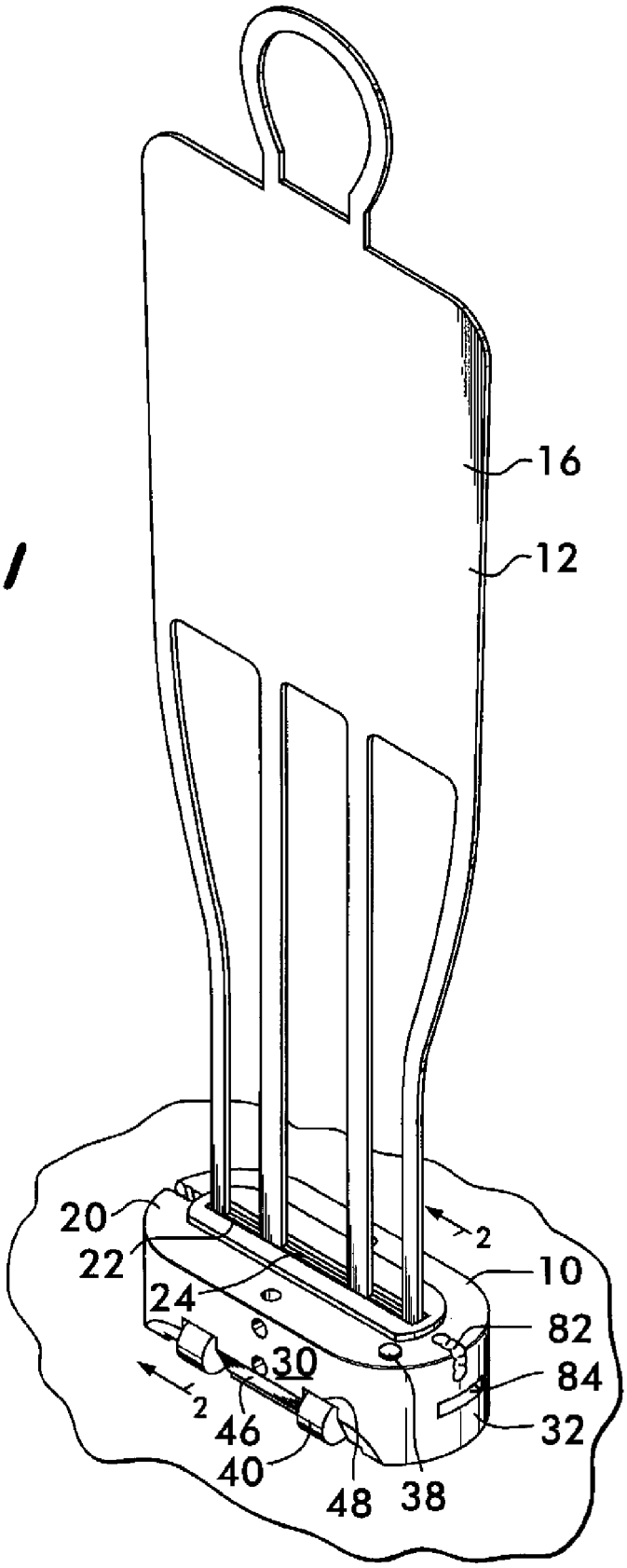
FIG. 1 is perspective view of a silhouette dummy and base support according to the present invention.

A silhouette-style dummy or mannequin 12 according to the present invention has a body portion 16 best illustrated in FIG. 1 projecting from an elongate base plug portion 18 best illustrated in FIG. 2. The illustrated embodiment is referred to as a "silhouette" dummy since it has the outline of a generally humanoid figure but has a relatively thin depth compared to its height and width. For purposes of example, the dummy 12 can be about six feet in height and about two feet wide. The silhouette style is preferred since it is relatively lightweight (for instance, about only eight pounds) and is capable of being stored and transported in a compact manner. However, if such features are not important, the dummy 12 can be provided of additional depth, for instance, like that of a traditional mannequin.

A preferred embodiment of the dummy 12 is molded as a single piece of plastic, elastomeric, composite, or other rigid, semi-rigid, flexible, or resilient and durable material that can hold its intended shape and/or is sufficiently resilient to return to its original shape after deformation. However, other construction types can also be used, such as those made with tubing, fabric, wood, metal, rubber, netting, composite, or like materials.

Figure 6:
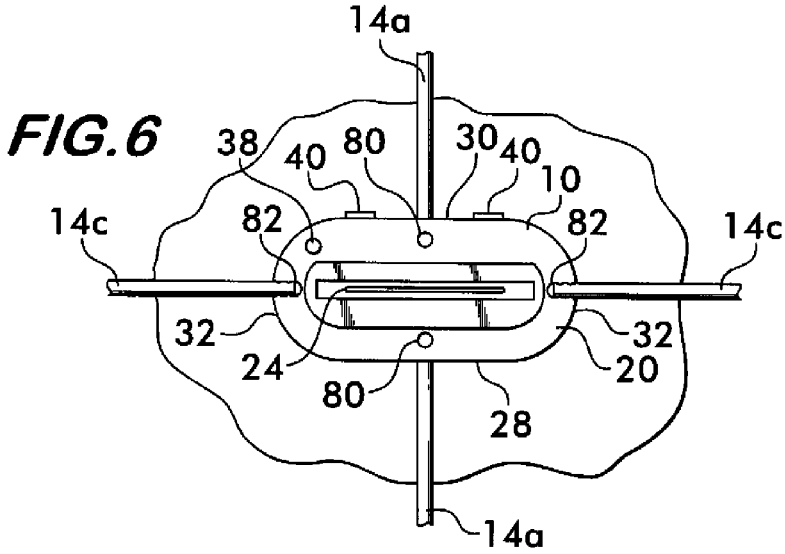
FIG. 6 is a plan view of the base support and selected coaching sticks according to the present invention.

According to the present invention, the dummy 12 is removably securable to the separate base, or support, 10 which serves the purpose of supporting the dummy 12 in an upstanding position on the playing surface. As best illustrated in FIGS. 1 and 6, the base 10 has an upper wall 20 defining an entrance opening, or rim, 22 of an upwardly-opening elongate slot 24. The base plug portion 18 of the dummy 12 is receivable within the slot 24 so that the dummy 12 can be supported by the base 10.

The base 10 can be weighted to eliminate any need for ground or like anchoring stakes and to permit the base 10 and dummy 12 combination to be used on any playing field surface including all natural, artificial, indoor and outdoor surfaces. Preferably, the base 10 includes wheels permitting the combination to be readily relocated anywhere on the playing field despite its weight. Thus, the combination is not staked to the playing field; rather, it merely sits or rests in a stationary upright condition on the surface of the playing field due to the force of gravity and friction and can be readily relocated when desired.

In the illustrated embodiment, the base 10 has a generally block or brick shaped body with the upper wall 20, an opposed bottom wall 26 for frictional engagement with the surface of the playing field, front and rear upstanding walls, 28 and 30, and opposed arcuate sidewalls 32. The base 10 is of a height such that it can provide a sufficient depth for the elongate, horizontally-disposed slot 24 and is of a length and width that provides sufficient stability. The front and rear upstanding walls, 28 and 30, and the arcuate sidewalls 32 are also of a sufficient size and rigidity to provide a surface off which a ball, such as a soccer ball, can rebound. As an example of contemplated dimensions, the base 10 can be about twenty-six inches in length, about twelve inches wide, and have a height of about eight inches.

Figure 4:
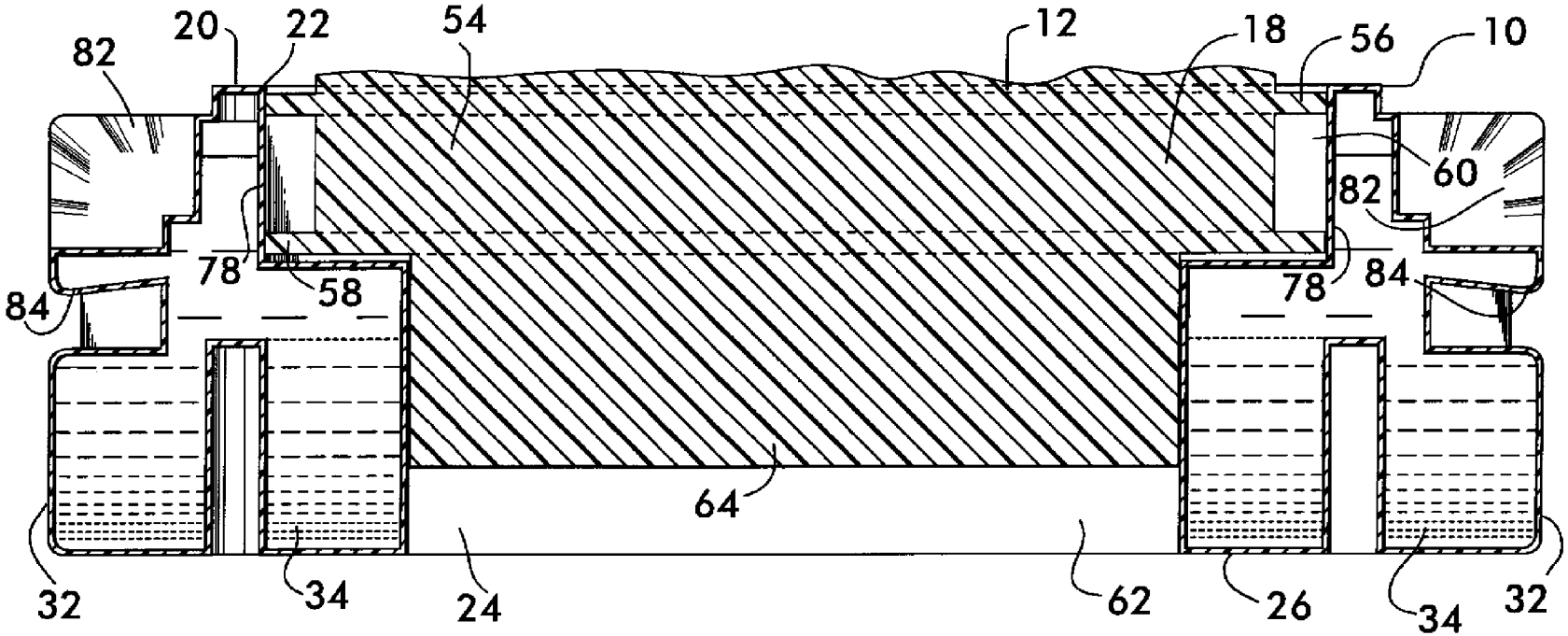
FIG. 4 is a cross-sectional view along line 4-4 of FIG. 2.

The slot 24 extends internally of the base 10 between and generally parallel to the front and rear walls, 28 and 30. The slot 24 extends from the opening 22 in the upper wall 20 to the bottom wall 26. As best illustrated in FIGS. 2 and 4, the slot 24 can extend completely through the body of the base 10 and be open on both upper and lower ends. Alternatively, the slot can be closed adjacent the bottom wall of the base.

Preferably, the body of the base 10 is molded of relatively rigid plastic and is generally hollow defining one or more chambers 34 that can be filled with a liquid, such as water, or a solid, such as sand or like ballast material. While the base 10 is relatively lightweight in an empty condition, it is provided with sufficient weight to properly support the dummy 12 when filled with water, sand, or the like. For this purpose, the base 10 is provided with a fill port 36 and removable cap 38 on its upper wall 20 enabling ready filling and emptying of the base, as desired. Thus, the base 10 can be filled such that it is weighted during use and emptied so that it is lightweight for storage, handling, and transport.

A pair of wheels 40 is supported on an axle 42 that is connected to a rear bottom corner 44 of the base 10 (ee FIGS. 2 and 3). As illustrated, the base 10 has a truncated rear bottom corner wall 46 and defines wheel wells 48 and a downwardly-opening slot 50 for receiving the axle 42. The axle 42 is designed to simply snap-fit to the base 10 within the slot 50 permitting ready assembly of the wheels 40 to the base 10. For example, the slot 50 can include an internal rib, or abutment, 52 or the like that the axle 42 must snap beyond during assembly but which prevents undesired release of the axle 42 from the slot 50 during use.

The wheels 40 are assembled to the base 10 such that, when the base 10 is supported on its bottom wall 26 on the playing surface, the base 10 remains in a stationary position due to the friction between the bottom wall 26 and the playing surface. However, if movement of the base 10 and dummy 12 is required, the base 10 with attached dummy 12 is tilted rearward such that the weight of the base 10 and dummy 12 is supported on the playing surface solely via the wheels 40. In this rearward tilted position, the base 10 and dummy 12 combination can be wheeled to a desired location on or off the playing field and then returned to an upright stationary position.

As best illustrated in FIGS. 2 and 4, the base plug portion 18 of the dummy 12 preferably includes a narrow elongate strip 54 that is parallel to and/or co-planar with the body portion 16 of the silhouette dummy 12. Upper and lower flanges, 56 and 58, extend transversely from opposite faces of the strip 54 and are receivable within the slot 24 of the base 10. The lower flange 56 is used to lock the dummy 12 to the base 10, while the upper flange 58 stabilizes the dummy in a generally upright position and allows some movement and flexure of the dummy 12 relative to the base 10, such as when the dummy 12 is contacted by a player, ball or the like.

The slot 24 of the base 10 includes an enlarged upper section 60 and a narrow lower section 62. The flanges 56 and 58 of the dummy 12 are received in the upper section 60 while a tail portion 64 of the strip 54 is received in the lower section 62. (See FIGS. 2 and 4.) As best shown in FIG. 2, the tail portion 64 fits with little clearance between the opposed walls 66 of the lower section 62 of the slot 24 and thereby orients the body portion 16 of the silhouette dummy 12 in a substantially upright position as it projects from the base 10. The body portion 16 of the dummy 12 is sufficiently rigid to stand upright, but has some flexibility and/or resiliency to permit it to absorb contact from players, balls and the like without damage and return to its original intended shape.

The upper section 60 of the slot 24 includes a laterally-extending shoulder 68 and opposed upwardly tapered walls 70 that extend to the opening, or rim, 22 of the slot 24. The opposed tapered walls 70 include areas of increased thickness or the like that provide inwardly-extending locking protrusions 72. The protrusions 72 form a reduced throat section 74 of the slot 24 a spaced distance above the shoulder 68. A flange-receiving area 76 of the slot 24 is located between the shoulder 68 and the protrusions 72 and has an enlarged width sized to accommodate the lower flange 58 of the dummy 12.

Accordingly, when the lower flange 58 of the dummy 12 is snapped past the pair of protrusions 72 and throat 74 of the slot 24, the lower flange 58 is captured and locked within area 76 of the slot 24 between the protrusions 72 and shoulder 68. In this condition, the dummy 12 is locked to the base 10 and the upper flange 56 of the dummy 12 is allowed a small degree of forward and rearward movement before engaging the opposed tapered walls 70 of the slot 24 adjacent the opening, or rim, 22 of the slot 24. The slot 24 also includes opposed endwalls 78 that prevent lateral movement of the base plug portion 18 of the dummy 12 relative to the base 10.

In use, the base plug portion 18 of the dummy 12 is inserted into the opening 22 of the slot 24 of the base 10 and sufficient hand pressure is exerted downward on the dummy 12 to cause the lower flange 58 to snap past the protrusions 72 into area 76 of the slot 24. In this locked condition, the base 10 and dummy 12 combination can be tilted and pushed or pulled on the wheels 30 as a single unit. When disassembly is desired, a user places their foot on the base 10 and exerts hand pressure in an upward direction on the dummy 12 to cause the lower flange 58 of the dummy 12 to snap past protrusions 72 of the slot 24. This disengages the dummy 12 from the base 10 and permits separate storage, handling, and/or transport.

Although a specific means for connecting the dummy 12 to the base 10 is described above, alternate means can also be utilized. These connection means can include any type or configuration of friction or snap fit mechanisms or the use of fasteners or the like. For instance, any configuration of cooperating grooves, ribs, beads or the like providing a snap fitting configuration can be used, and any type of mechanical fastener such as straps, clips, clamps, latches, or the like can be used.

The base 10 according to the present invention can also support an arrangement of one or more coaching sticks 14 extending and/or projecting from the base 10. For examples, see FIGS. 5 and 6.

Figure 5:
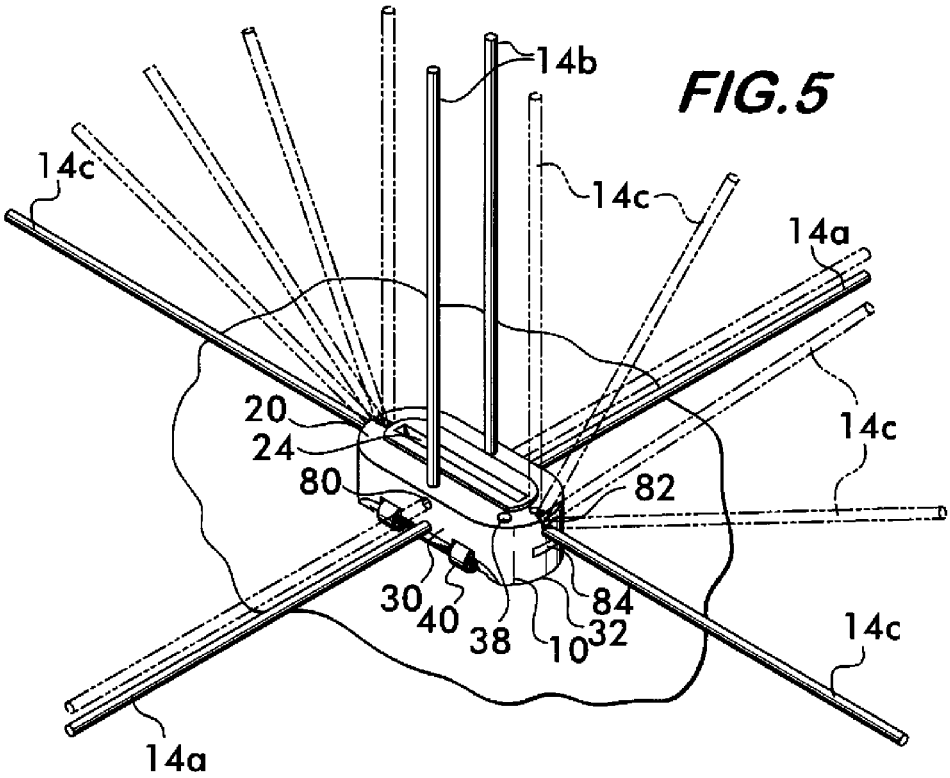
FIG. 5 is a perspective view of an arrangement of coaching sticks that are removably connectable to the base support of the present invention.

A plurality of coaching stick receiving receptacles 80 can be formed in the hollow body of the base 10 such that the base 10 can receive and engage end portions of coaching sticks 14. The coaching stick support receptacles 80 can be provided on the upper wall 20 of the base 10, the sidewalls 32 of the base 10, and the front and rear walls, 28 and 30, of the base 10. FIGS. 5 and 6 illustrate coaching sticks 14*a* extending from the front and rear walls, 28 and 30, of the base 10, and FIG. 5 illustrates coaching sticks 14*b* extending from the upper wall 20 of the base 10.

Some of the coaching stick receptacles, such as receptacles 82, permit adjustment of the angle at which the coaching stick 14*c* extends from the base 10. The receptacles 82 may be located in the upper corners of the base 10 and enable the coaching sticks 14*c* to extend substantially vertically, substantially horizontally, or at various angles therebetween. For example, the coaching stick 14*c* can extend at an angle of about 23° from the playing surface, about 45° from the playing surface, or about 68° from the playing surface. See FIG. 5.

The base 10 can support the dummy 12, coaching sticks 14, or both depending upon the particular training exercise. As an example, a plurality of the dummies 12 can be arranged in a spaced-apart row, and a player may be required to dribble a soccer ball and weave through the arrangement of dummies 12. Coaching sticks can be added to increase the difficulty of this exercise or can be used during other training exercises. The dummies 12 and/or coaching sticks 14 can also be located to provide defenders or opponents through which passes must be made or drills are run.

Finally, the sidewalls 32 of the base 10 can be provided with indentations providing grips 84 for lifting, manipulating, or carrying the base 10. Further, the base 10 is stackable with like bases in a compact manner for efficient shipping and storage.

While preferred training assemblies, base supports, dummies, and coaching sticks have been described in detail, various modifications, alterations, and changes may be made without departing from the spirit and scope of the training devices according to the present invention as defined in the appended claims.

The invention claimed is:

1. A training device for use as a playing field obstacle during athletic training exercises, comprising:

a weighted base having a bottom wall supportable in a stationary position on an underlying ground surface solely due to the forces of friction and gravity, said base having at least one wheel and an upper wall with an upward-opening slot, and a detachable dummy obstacle having a body portion and a base plug portion, said base plug portion being receivable within said slot and being removably connectable to said base such that, when said dummy obstacle is connected to said base, said body portion of said dummy obstacle is supported in a substantially upright position from said base, and at least one coaching stick detachable from said base, wherein said base includes at least one receptacle for removably securing and supporting said at least one coaching stick in a position extending or projecting from said base, wherein said receptacle of said base is an angle adjustment receptacle that enables adjustment of an angle at which said coaching stick projects or extends from said base.

2. A training device according to claim 1, wherein said body portion of said dummy obstacle is a silhouette dummy of humanoid form, and wherein said silhouette dummy is supportable on said base in said substantially upright position on artificial and natural surfaces without ground insertion anchors.

3. A training device according to claim 2, wherein said at least one wheel extends laterally of said bottom wall of said base such that, when said base is tilted toward said at least one wheel, said base is supported on the underlying ground surface solely via said at least one wheel.

4. A training device according to claim 3, wherein said at least one wheel is located on an axle that snaps onto said base without the use of mechanical fasteners or tools.

5. A training device according to claim 3, wherein said base plug portion of said dummy obstacle includes at least one transversely-extending flange receivable within said slot of said base.

6. A training device according to claim 5, wherein said slot of said base includes a throat section and a shoulder located below said throat section, and wherein said transversely-extending flange of said base plug portion of said dummy obstacle is locked to said base when said transversely-extending flange is snapped through said throat section and located within said slot between said throat section and said shoulder.

7. A training device according to claim 6, wherein said throat section of said slot is formed by an opposed pair of protrusions extending from opposed tapered walls of said slot.

8. A training device according to claim 7, wherein said base plug portion of said dummy obstacle includes a tail section that extends parallel to or co-planar with said body portion of said silhouette dummy, and wherein said slot of said base includes a lower section extending below said shoulder into which said tail section is received for purposes of orienting said body portion in an upstanding position.

9. A training device according to claim 8, wherein said transversely-extending flange is a lower transversely-extending flange, wherein base plug portion of said dummy obstacle includes an upper transversely-extending flange spaced above said lower transversely-extending flange, and wherein said upper transversely-extending flange is receivable within said slot and engagable with said opposed tapered walls of said slot to stabilize said body portion of said dummy obstacle in said upstanding position.

10. A training device according to claim 9, wherein said dummy obstacle is of one-piece molded construction.

11. A training device according to claim 3, wherein said base has at least one hollow chamber and includes a fill port for access to said at least one hollow chamber for purposes of filling said at least one hollow chamber with a flowable ballast material, wherein said base includes handle indentations and is stackable with a plurality of like bases, and wherein said base has rigid front, rear and side walls providing surfaces off which balls can rebound.

12. A training device for use as a playing field obstacle during athletic training exercises, comprising:

a rigid, substantially-hollow, plastic base having a bottom wall supportable in a stationary position on an underlying ground surface solely due to the forces of friction and gravity;

said base having at least one wheel extending laterally of said bottom wall of said base such that, when said base is tilted toward said at least one wheel, said base is supported on the underlying ground surface solely via said at least one wheel;

said base having an upper wall with an elongate upward-opening forming a slot for receiving and removably connecting a detachable silhouette dummy obstacle in a substantially upright position to said base;

said base including a plurality of support receptacles for removably securing and supporting a plurality of coaching sticks to said base such that said plurality of coaching sticks extend or project outwardly from said base;

wherein at least one of said support receptacles of said base is an angle adjustment receptacle that enables adjustment of an angle at which one of said plurality of coaching sticks projects or extends from said base; and said base including at least one chamber and having a fill port for providing access to said at least one chamber for filling said at least one chamber with a flowable ballast material.

13. A training device according to claim 12, wherein said at least one wheel is located on an axle that snaps onto said base without the use of mechanical fasteners or tools.

14. A training device according to claim 12, wherein said slot of said base includes a throat section and a shoulder located below said throat section providing a snap engagement mechanism for securing the silhouette dummy obstacle to said base.

15. A training device according to claim 12, wherein said throat section of said slot is formed by an opposed pair of protrusions extending from opposed tapered walls of said slot.

16. A training device according to claim 15, wherein said slot of said base includes a lower section extending below said shoulder into which a section of the silhouette dummy obstacle is receivable for orienting the silhouette dummy obstacle in an upstanding position.

* * * * *